United States Patent [19]

Aoyama

[11] Patent Number: 4,960,281

[45] Date of Patent: Oct. 2, 1990

[54] GOLF BALL

[75] Inventor: Steven Aoyama, Marion, Mass.

[73] Assignee: Acushnet Company, New Bedford, Mass.

[21] Appl. No.: 422,511

[22] Filed: Oct. 17, 1989

[51] Int. Cl.[5] ..... A63B 37/14

[52] U.S. Cl. ..... 273/232; 273/62

[58] Field of Search ..... 273/232, 213, 220, 62, 273/235 R, 183 C; 40/327

[56] References Cited

U.S. PATENT DOCUMENTS

| | | | |
|---|---|---|---|
| 4,266,773 | 5/1981 | Treatwell | 273/232 |
| 4,284,276 | 8/1981 | Worst | 273/232 |
| 4,346,898 | 8/1982 | Badke | 273/232 |

*Primary Examiner*—George J. Marlo

*Attorney, Agent, or Firm*—Lucas & Just

[57] ABSTRACT

The golf ball has no three dimples in a row with edges aligned. This pattern produces a golf ball with reduced drag. The preferred golf ball has multiple sizes of dimples.

13 Claims, 9 Drawing Sheets

GOLF BALL

This invention relates to golf balls and, more particularly, to golf balls wherein no three dimples in a row on the surface of the golf ball have edges that align. Preferably, multiple sized dimples are used.

Typically, golf balls are made in a molding process wherein dimples are formed in the spherical surface of the golf ball. This molding process is done in a conventional manner either by injection molding cover stock about a core or by compression molding preformed half shells about a core. Generally, the core is either a solid mass of rubber, which gives rise to a two piece golf ball or a wound core which gives rise to a three piece golf ball. The wound core is made by winding thin elastic thread about a center. The center is either a solid mass of rubber or a liquid filled sphere which has been frozen temporarily to facilitate winding of the thread about the center. One piece golf balls are made from a mass of material and are not considered to have a core, either solid or wound.

The United States Golf Association (USGA) promulgates rules, one of which is directed to symmetry of a golf ball. The USGA symmetry requirement dictates that a golf ball must be designed and manufactured to perform in general as if it were spherically symmetrical. Meeting this task can be difficult.

The present invention provides a golf ball having a spherical surface with a plurality of dimples formed therein and no three dimples in a row having edges that align. All the dimples can have the same nominal dimple diameter; however, in many situations it is preferable that adjacent dimples have substantially different nominal dimple diameters.

Golf balls made in accordance with the present invention are thought to have a higher lift to drag ratio than conventionally made balls. The lift to drag ratio is the ratio of the lift force on the golf ball to the drag force on the golf ball at any one moment during the flight of the golf ball through the air. The lift force is the aerodynamic force exerted on the golf ball upward and normal to the direction of travel of the golf ball during flight. The drag force on the golf ball is the aerodynamic force exerted on the golf ball in a direction 180° from the direction of flight of the golf ball. It is thought that by having no three dimples in a row having edges that align, the lift to drag ratio of the golf ball of the present invention is higher than that of conventional golf balls which typically have rows of three or more dimples having their edges aligned. As a practical matter, a higher lift to drag ratio means that the ball can be made to travel farther.

Preferably, the dimples are formed in the spherical surface of the golf ball by having four parting lines which correspond to four great circular paths that encircle the golf ball where none of the parting lines intersects any of the dimples. The dimples are arranged in two patterns. One pattern forms a spherical square while the other pattern forms a spherical triangle. The surface of the golf ball is covered with six spherical squares and eight spherical triangles, both shapes occupying fairly large areas on the surface of the golf ball. It has been found that such a pattern is symmetrical and also lends itself to good overall surface coverage and minimum land area when multiple sized dimples are placed on the surface of the golf ball.

Preferably, a golf ball is made in accordance with the present invention by dividing the surface of the golf ball into six spherical squares and eight spherical equilateral triangles. These spherical triangles and spherical squares are located by inscribing an octahedron inside the spherical surface of a golf ball, projecting the octahedron onto the surface of the sphere, locating the midpoint on each edge of the octahedron and then connecting each of the midpoints to its nearest neighboring midpoints. The geometric form left after connecting the midpoints has six spherical squares and eight spherical equilateral triangles. The great circular paths follow the edges of the spherical squares and spherical triangles so formed. Each one of the four great circular paths passes through six midpoints. The four great circular paths correspond to the position of the parting lines on the surface of the golf ball. The parting lines are coextensive with the four great circular paths. Preferably, the mold parting line corresponds to one of the parting lines of the present invention, with the other three parting lines being false parting lines.

Dimples are distributed over the surface of the golf ball by arranging dimples inside each of the six spherical squares and in each of the eight spherical equilateral triangles, making sure that none of the dimples intersect any of the parting lines and making sure that no three dimples in a row have edges that align. Preferably, at least about 50% of the surface of the golf ball is covered with dimples. Preferably, each spherical square has the same dimple pattern as every other spherical square on the surface of the golf ball and each spherical triangle has the same dimple pattern as every other spherical triangle on the surface of the golf ball.

The preferred dimple patterns have 440 and 456 dimples. Some manufacturers remove a small number of dimples, typically eight, four at each pole, so that a trademark and identification number can be affixed to the ball (e.g. 432 and 448). However, modern stamping methods allow for affixing trademarks and identification numbers without the removal of dimples. Thus, the preferred golf ball of the present invention has about 432 to 440 or about 448 to 456 dimples.

These and other aspects of the present invention may be more fully described with reference to the accompanying drawings wherein:

FIGS. 1–7 illustrate the preferred method for arranging dimples on the surface of the golf ball in accordance with the present invention.

Figure 1:
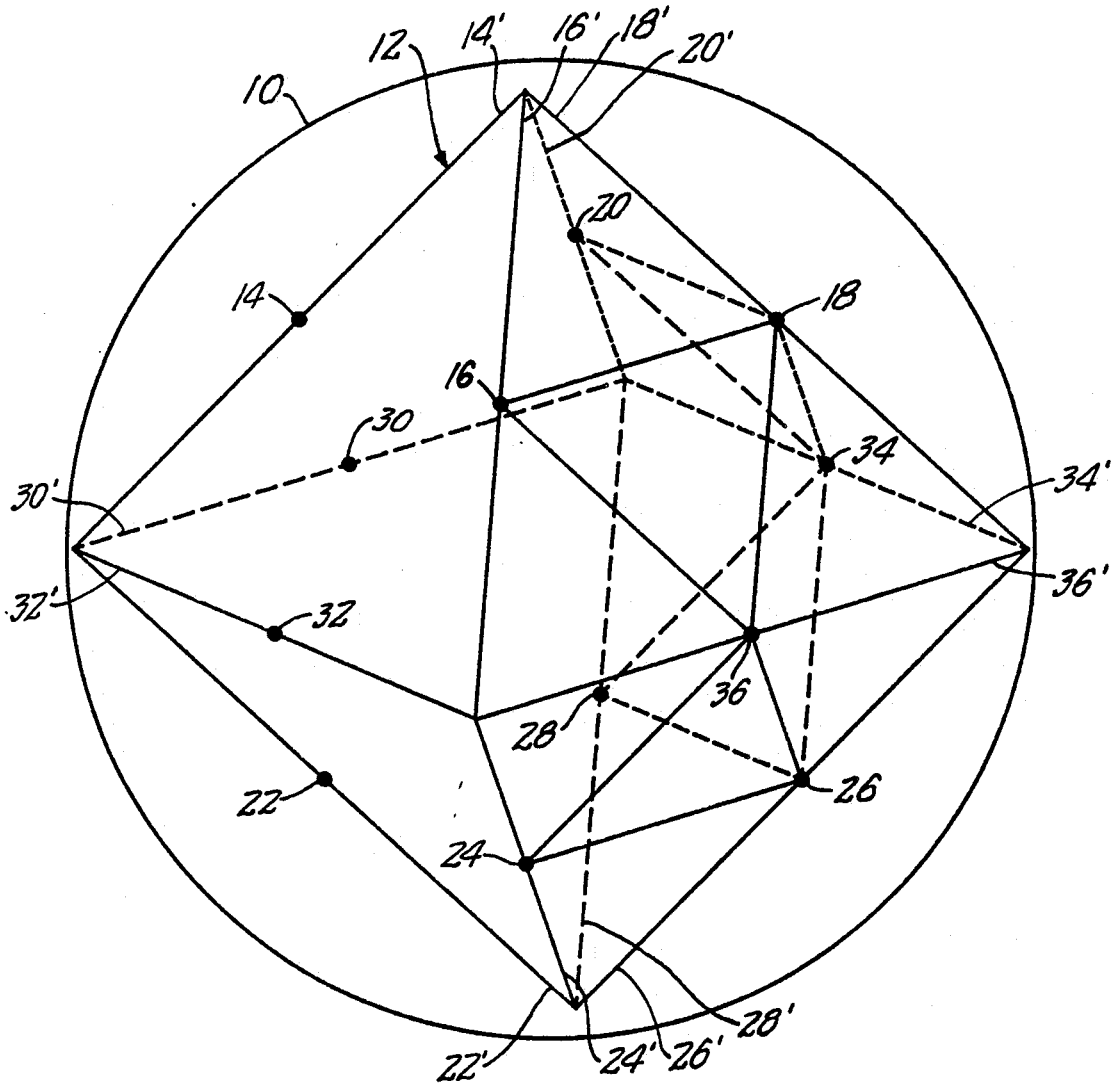
FIG. 1 illustrates an octahedron inscribed in a sphere in accordance with the present invention.

FIG. 1 illustrates sphere 10 inside of which octahedron 12 is inscribed. The twelve midpoints of each edge of octahedron 12 are numbered 14, 16, 18, 20, 22, 24, 26, 28, 30, 32, 34 and 36. The edges are identified in FIG. 1 by a prime, i.e. 14', 16', 18', 20', 22', 24', 26', 28', 30', 32', 34' and 36'. By connecting each set of midpoints of each side of each face of octahedron 12, an equilateral triangle is created, thus making the eight equilateral triangles of the present invention. For example, midpoints 16, 18 and 36 are connected to create an equilateral triangle having its three vertices identified by the set of three midpoints 16-18-36. The same has been done for all four faces of the octahedron on the right side of FIG. 1. Specifically, the three remaining equilateral triangles on the right hand side of FIG. 1 are identified by sets of three midpoints: 24-26-36; 26-28-34; and 18-20-34. These sets of midpoints identify the vertices of each equilateral triangle. It is clear that by connecting the midpoints of edges 14', 16', 20', 22', 24', 28', 30' and 32' on the left hand side of FIG. 1, the remaining four equilateral triangles are formed. These remaining four equilateral triangles are identified by the following sets of three midpoints: 14-16-32; 14-20-30; 22-24-32; and 22-28-30.

The four corners of the six squares are also identified as four midpoints which correspond to the four corners of the square. Specifically, these squares are formed about each one of the six apexes of the octahedron. The four corners of each of the six squares correspond to the following six sets of four midpoints: 18-36-26-34; 16-18-20-14; 14-32-22-30; 34-20-30-28; 28-22-24-26; and 36-16-32-24.

It should be noted that in connecting the midpoints of each edge of the octahedron, only the midpoints belonging to one face are interconnected and none of the midpoints on one face are connected to midpoints on another face, except where there is a common edge. In other words, all midpoint connecting lines travel on the surface of the octahedron, not through the octahedron.

Each one of the four great circular paths passes through six midpoints of the edges of the octahedron and corresponds to the edges of the equilateral triangles and squares which were formed in the manner described above. Each great circular path is defined by the following set of six midpoints: 24-36-18-20-30-22; 24-26-34-20-14-32; 16-18-34-28-22-32; and 16-14-30-28-26-36.

Figure 2:
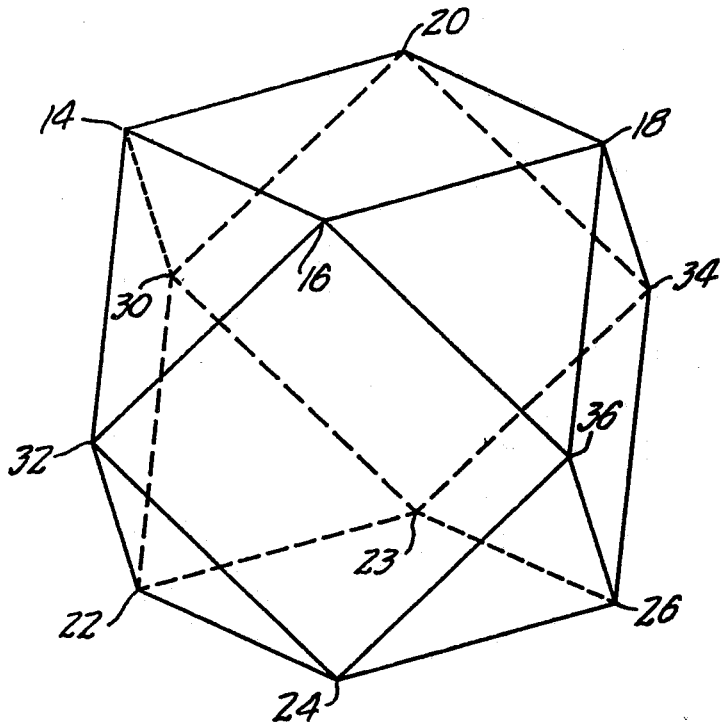
FIG. 2 illustrates the figure formed by the equilateral triangles and squares in accordance with the present invention.

These paths are clear from FIG. 2 wherein the lines representing the octahedron have been deleted and the lines connecting the midpoints remain. The midpoints are identified in FIG. 2. The four parting lines correspond to the four great circular paths.

The four great circular paths have a diameter equal to that of sphere 10. Dimples are arranged within the geometric figures, equilateral triangles and squares, formed between the great circular paths. None of the great circular paths intersect the dimples.

Figure 3:
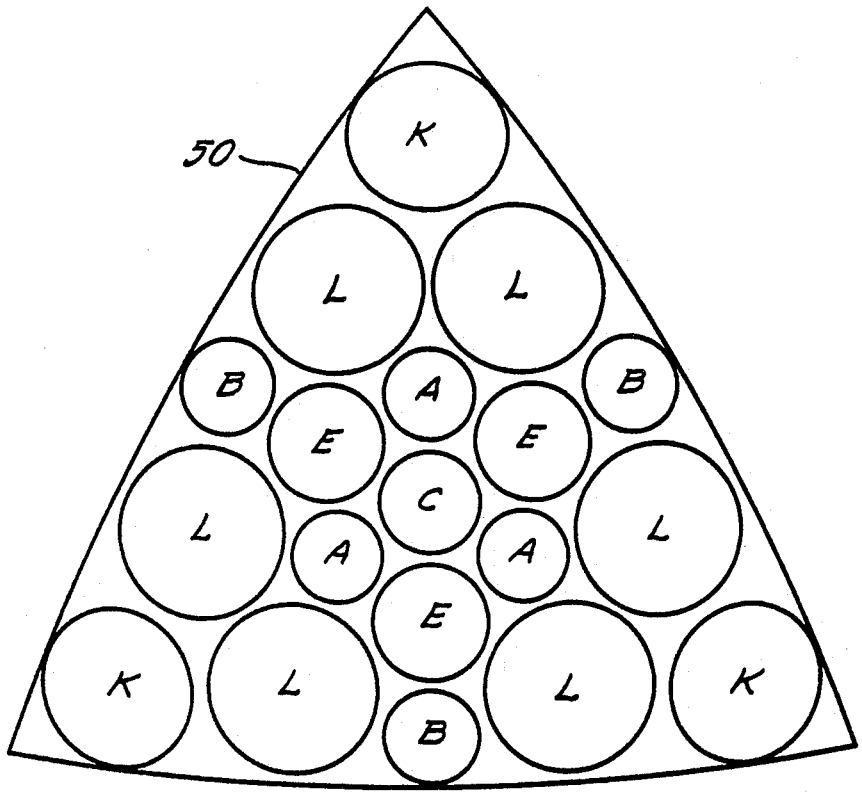
FIG. 3 illustrates a preferred spherical equilateral triangle having a dimple pattern for a golf ball with 440 dimples made in accordance with the present invention.
Figure 4:
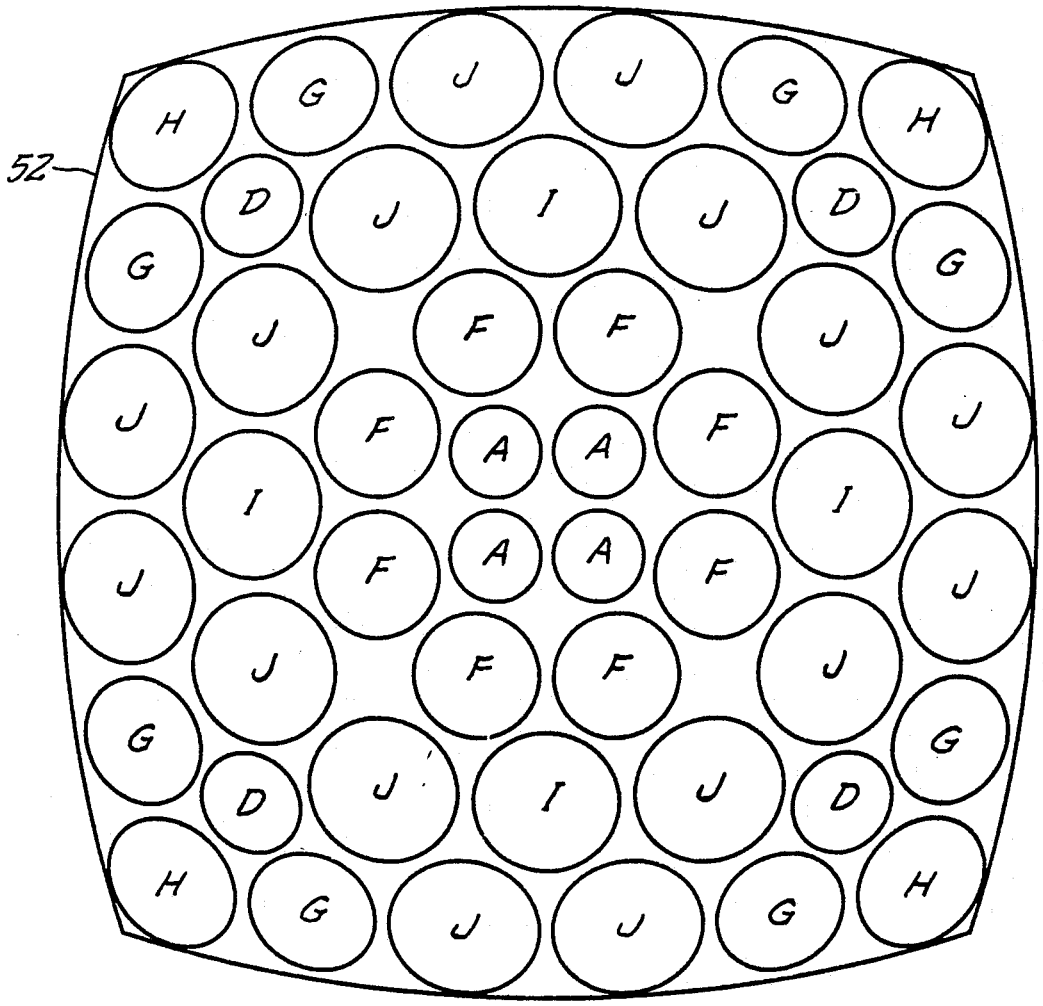
FIG. 4 illustrates a preferred spherical square having a dimple pattern for a golf ball with 440 dimples made in accordance with the present invention.

FIGS. 3 and 4 illustrate a preferred dimple pattern of a spherical equilateral triangle and a spherical square used for making a golf ball in accordance with the present invention having 440 dimples thereon. FIG. 3 illustrates a preferred spherical equilateral triangle 50 having a dimple pattern in accordance with the present invention for making a golf ball with 440 dimples. FIG. 4 illustrates a preferred spherical square 52 having a dimple pattern for a golf ball made in accordance with the present invention. Such a pattern produces a preferred 440 dimples.

The two sets of preferred dimensions for the respectively labeled dimples in FIGS. 3 and are given below in Tables I and II:

TABLE I

| Type | (FIG. 3 and 4) Diameter (inches) | Depth (inches) |
|---|---|---|
| A | 0.090 | 0.0071 |
| B | 0.095 | 0.0075 |
| C | 0.100 | 0.0079 |
| D | 0.105 | 0.0083 |
| E | 0.115 | 0.0091 |
| F | 0.125 | 0.0099 |
| G | 0.130 | 0.0102 |
| H | 0.140 | 0.0110 |
| I | 0.145 | 0.0114 |
| J | 0.150 | 0.0118 |
| K | 0.160 | 0.0126 |
| L | 0.170 | 0.0134 |

TABLE II

| Type | (FIG. 3 and 4) Diameter (inches) | Depth (inches) |
|---|---|---|
| A | 0.090 | 0.0079 |
| B | 0.095 | 0.0083 |
| C | 0.100 | 0.0088 |
| D | 0.105 | 0.0092 |
| E | 0.115 | 0.0101 |
| F | 0.125 | 0.0110 |
| G | 0.130 | 0.0114 |
| H | 0.140 | 0.0123 |
| I | 0.145 | 0.0127 |
| J | 0.150 | 0.0131 |
| K | 0.160 | 0.0140 |
| L | 0.170 | 0.0149 |

Figure 5:
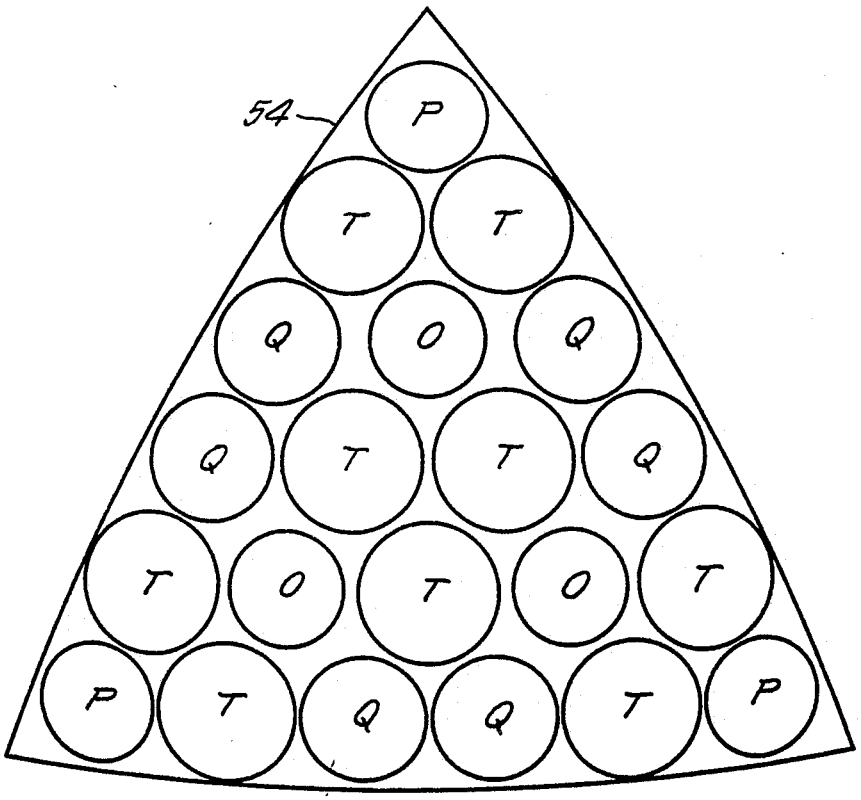
FIG. 5 illustrates a preferred spherical equilateral triangle having a dimple pattern for a golf ball with 456 dimples made in accordance with the present invention.
Figure 6:
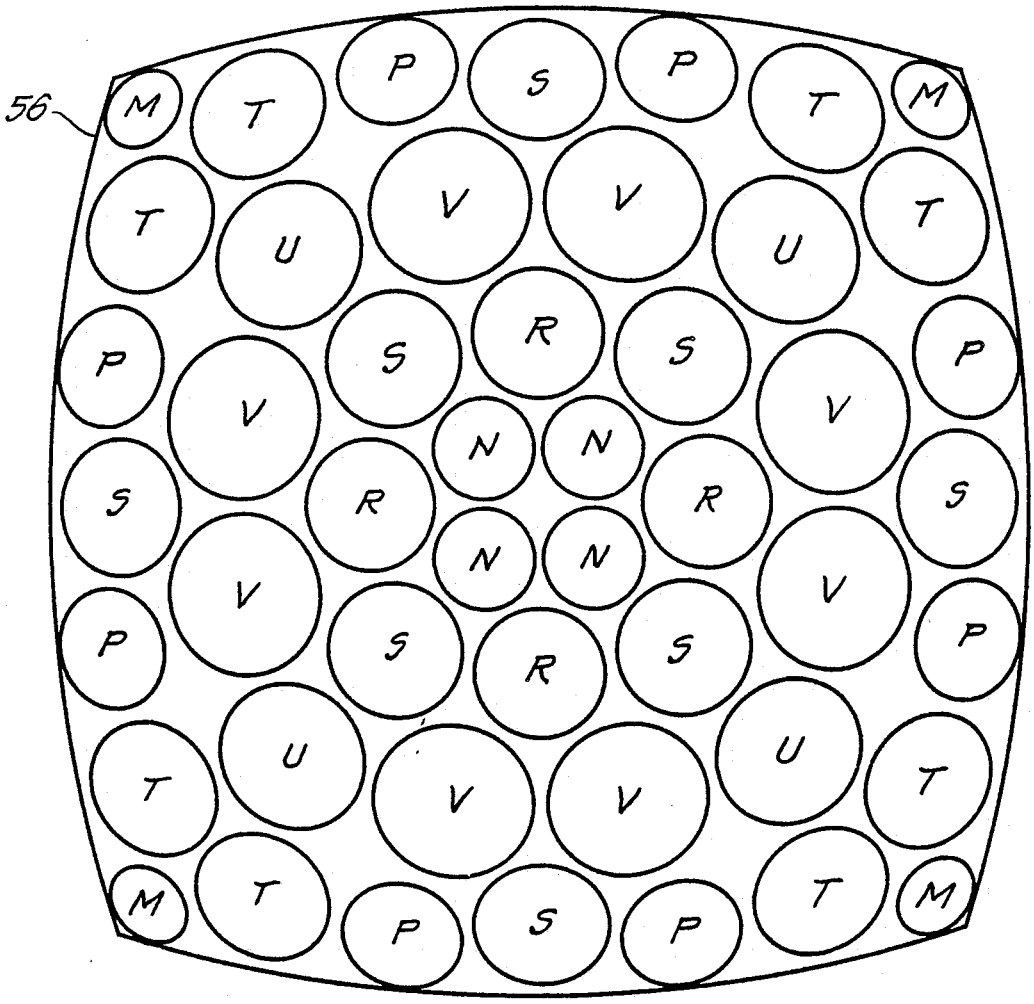
FIG. 6 illustrates a preferred spherical square having a dimple pattern for a golf ball with 456 dimples made in accordance with the present invention.

FIGS. 5 and 6 illustrate a preferred dimple pattern of a spherical equilateral triangle and a spherical square used to make a golf ball in accordance with the present invention having 456 dimples. FIG. 5 illustrates a preferred spherical equilateral triangle 54 having a dimple pattern for a golf ball made in accordance with the present invention such that a golf ball with a preferred 456 dimples is produced. FIG. 6 illustrates a preferred spherical square 56 having a dimple pattern for a golf ball made in accordance with the present invention such that a golf ball with a preferred 456 dimples is produced.

The preferred dimensions for the respectively labeled dimples in FIGS. 5 and 6 are given below in Table III:

TABLE III

| Type | (FIGS. 5 and 6) Diameter (inches) | Depth (inches) |
|---|---|---|
| M | 0.085 | 0.0067 |
| N | 0.100 | 0.0079 |
| O | 0.115 | 0.0091 |

TABLE III-continued

| Type | (FIGS. 5 and 6) Diameter (inches) | Depth (inches) |
|---|---|---|
| P | 0.120 | 0.0095 |
| Q | 0.125 | 0.0099 |
| R | 0.130 | 0.0102 |
| S | 0.135 | 0.0106 |
| T | 0.140 | 0.0110 |
| U | 0.150 | 0.0118 |
| V | 0.160 | 0.0126 |

Figure 7:
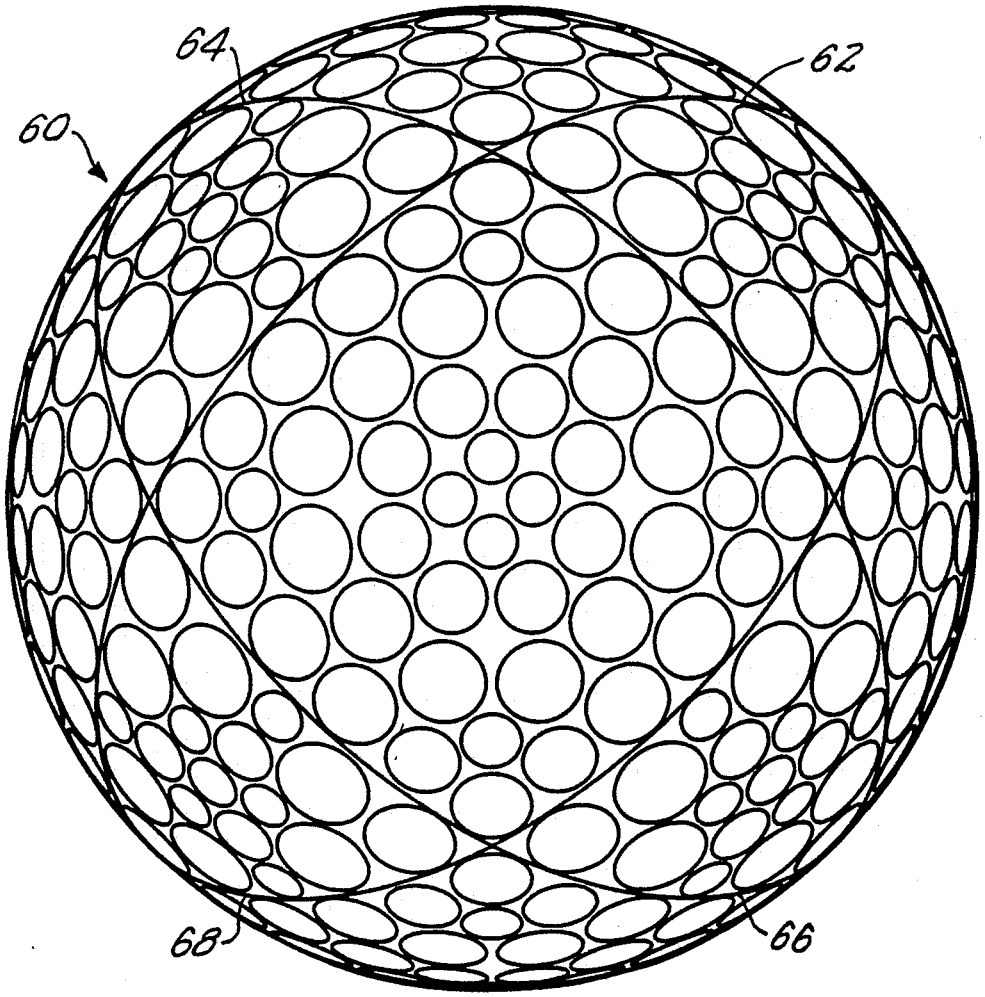
FIG. 7 illustrates a projected golf ball having 440 dimples made in accordance with the present invention.

FIG. 7 is a projected view of golf ball 60 made in accordance with the present invention and having 440 dimples thereon. The great circular paths have been numbered 62, 64, 66 and 68.

Figure 8:
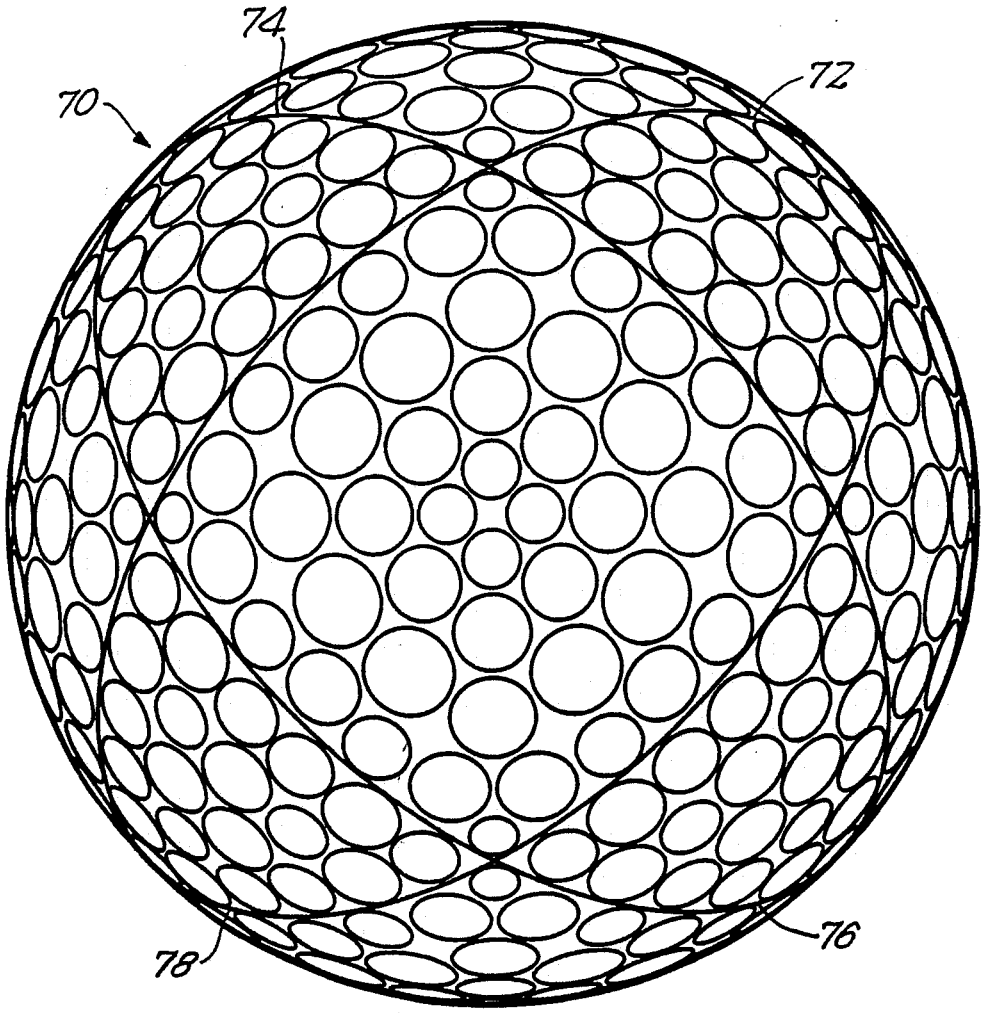
FIG. 8 illustrates a projected golf ball having 456 dimples made in accordance with the present invention.

FIG. 8 is a projected view of golf ball 70 made in accordance with the present invention and having 456 dimples thereon. The great circular paths have been numbered 72, 74, 76 and 78.

Figure 9:
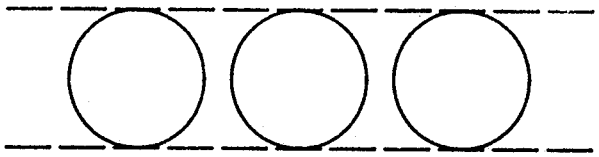
FIG. 9 illustrates three dimples in a row with edges aligned.
Figure 10:
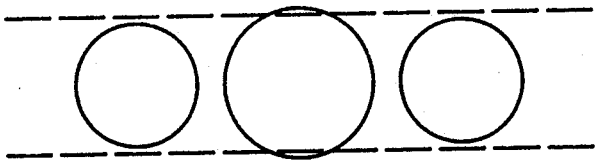
FIG. 10 illustrates three dimples in a row with different dimple diameters and edges not aligned.
Figure 11:
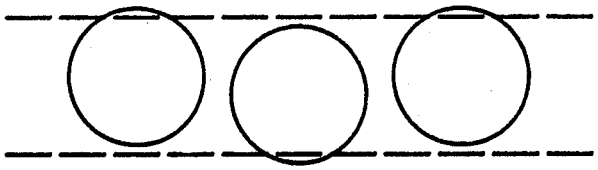
FIG. 11 illustrates three dimples in a row with similar dimple diameters and edges not aligned.
Figure 12:
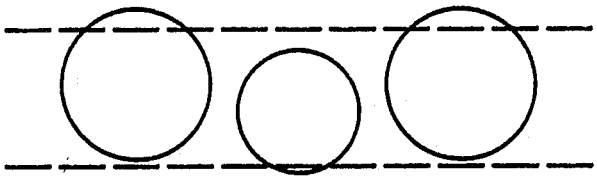
FIG. 12 illustrates three dimples in a row with edges not aligned.

To illustrate dimples with edges aligned and edges not aligned, FIGS. 9–12 are presented herein. FIG. 9 illustrates three dimples in a row having edges that are aligned. FIGS. 10–12 illustrate three dimples in a row with edges not aligned. In FIG. 10 the dimples alternate nominal dimple diameter. In FIG. 11, the dimples are staggered and in FIG. 12 the dimples not only have different nominal dimple diameters but also are staggered.

Figure 13:
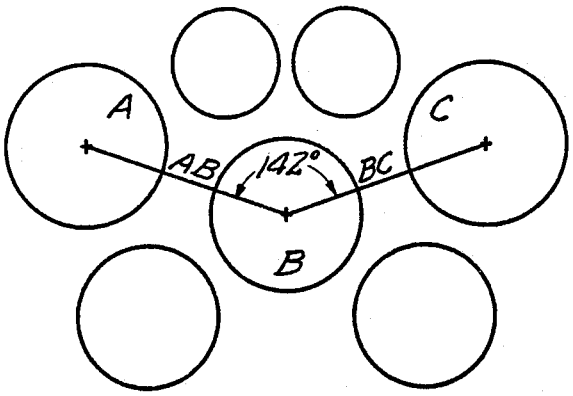
FIG. 13 illustrates a method for determining whether three dimples are in a row.

To determine if any three dimples are considered to be "in a row", the following steps are taken as illustrated in FIG. 13:

(1) The great circle arc segment AB is created between the centers of the first dimple A and the second dimple B.

(2) The great circle arc segment BC is created between the centers of the second dimple B and the third dimple C.

(3) Dimples A, B, and C are considered to be "in a row" if and only if:

(a) the angle between AB and BC at the center of dimple B is greater than or equal to 90°; and (b) neither AB nor BC intersect any dimple other than A, B or C.

In this case, the dimples A, B, and C of FIG. 13 are "in a row".

Figure 14:
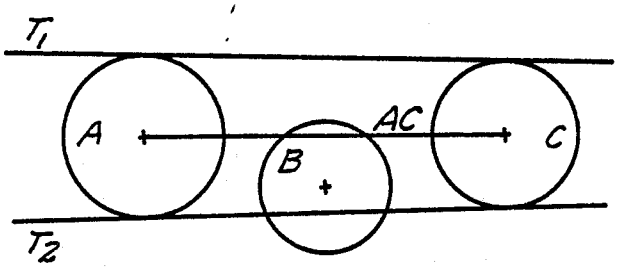
FIG. 14 illustrates a method for determining whether three dimples in a row have edges that align.

To determine if any three dimples in a row have "edges that align", the following steps are taken as illustrated in FIG. 14:

(1) The great circle arc segment AC is created between the centers of the first and third dimples of the row, A and C respectively.

(2) The great circle arc $T_1$ is created tangent to dimples A and C and not intersecting AC.

(3) The great circle arc $T_2$ is created tangent to dimples A and C and not intersecting AC.

(4) Dimples A, B, and C are considered to have "edges that align" if and only if:

(a) the center of dimple B is on the same side of $T_1$ as the centers of dimples A and C, and dimple B is tangent to $T_1$; or (b) the center of dimple B is on the same side of $T_2$ as the centers of dimples A and C, and dimple B is tangent to $T_2$.

In this case the dimples A, B and C of FIG. 14 do not have "edges that align."

These and other aspects of the present invention will be more fully appreciated with reference to the following example:

EXAMPLE 1

A flight test was performed using golf balls having surlyn covers and wound cores. Golf balls having patterns made in accordance with FIG. 7 and FIG. 8 and dimple dimensions in accordance with Tables I and III, respectively, were tested against a commercial ball having 384 dimples thereon sold under the trade name Titleist 384 DT by Acushnet Company. The results are illustrated below in Table IV:

TABLE IV

| Club | Distance (yds) FIG. 7 440 dimples | FIG. 8 456 dimples |
|---|---|---|
| Low Driver (11° loft angle) | +7.3 | +4.8 |
| Medium Driver (13° loft angle) | +2.3 | +2.5 |
| High Driver (15° loft angle) | −1.2 | −0.6 |
| #5 Iron (26° loft angle) | −2.5 | −1.6 |

Table IV gives the results relative to the 384 ball, e.g. "+7.3 yds" means that when hit with a low driver at a loft angle of 11°, the ball of FIG. 7 went 7.3 yards farther than the conventional 384 dimpled ball.

Measurements were made with a dual pendulum driving machine using four different club heads. The loft angle is the angle made by the face of the club head with the vertical at the point of impact with the ball.

The balls of FIG. 7 (440 dimples) and FIG. 8 (456 dimples) also flew higher than the conventional 384 dimpled ball, indicating that the lift to drag ratio of the balls made in accordance with the present invention was higher than that of the 384 dimpled ball.

By making no three dimples in a row having aligned edges, the aerodynamic drag of the golf ball is thought to be reduced. When adjacent dimple edges are aligned, the vortices formed due to air current over the golf ball surface are thought to become cumulative or to "stack up" thereby increasing the drag on the golf ball. By staggering the dimple edges, drag should decrease.

Preferably, to enable the balls made in accordance with the present invention to travel farther, a two piece construction, i.e. a solid core with one piece cover, is employed and the construct is such that the ball has a low spin rate in flight.

It has also been found that decreased land area and therefore increased dimple coverage of the golf ball surface can be obtained with the present invention.

A great circular path has the same diameter as that of the golf ball or sphere.

For any number appearing in the claims which is not modified by the term "about", it will be understood that the term "about" modifies such number. A dimple, as used in the specification and claims and as used in the golf industry, is a standard term well known to those of skill in the art.

When referring to a dimple diameter, the term "diameter" as used herein means the diameter of a circle defined by the edges of the dimple. When the edges of a dimple are non-circular, the diameter means the diameter of a circle which has the same area as the area defined by the edges of the dimples. When the term "depth" is used herein, it is defined as the distance from the continuation of the periphery line of the surface of the golf ball to the deepest part of a dimple which is a section of a sphere. When the dimple is not a section of a sphere, the depth in accordance with the present invention is computed by taking a cross-section of the dimple at its widest point. The area of the cross-section is computed and then a section of a circle of equal area is substituted for the cross-section. The depth is the distance from the continuation of the periphery line to the deepest part of the section of the circle.

It will be understood that the claims are intended to cover all changes and modifications of the preferred embodiment of the invention herein chosen for the purpose of illustration which do not constitute a departure from the spirit and scope of the invention.

What is claimed is:

1. A golf ball having a spherical surface with a plurality of dimples formed therein and no three dimples in a row having edges that align.

2. The golf ball of claim 1 wherein all dimples have substantially similar nominal dimple diameter.

3. The golf ball of claim 1 wherein no two adjacent dimples have a substantially similar nominal dimple diameter.

4. The golf ball of claims 1, 2 or 3 having about 432 to 440 dimples.

5. The golf ball of claims 1, 2 or 3 having about 448 to 456 dimples.

6. A golf ball having a spherical surface with a plurality of dimples formed therein, no three dimples in a row having edges that align, and four parting lines which do not intersect any dimples, the dimples being arranged by dividing the surface of the golf ball into eight equilateral triangles and six squares, said eight triangles and six squares being formed by inscribing an octahedron in said spherical surface, locating the midpoint on each edge of said octahedron and forming four great circular paths on said spherical surface wherein each great circular path passes through six midpoints, said four parting lines corresponding to said four great circular paths and said dimples being arranged in said eight equilateral triangles and six squares such that the dimples do not intersect the four parting lines.

7. The golf ball of claim 6 wherein each one of said six squares has a dimple pattern substantially similar to each other square and each one of said eight equilateral triangles has a dimple pattern substantially similar to each other equilateral triangle.

8. The golf ball of claims 6 or 7 wherein all dimples have substantially similar nominal dimple diameter.

9. The golf ball of claim 8 having about 432 to 440 dimples.

10. The golf ball of claim 8 having about 448 to 456 dimples.

11. The golf ball of claims 6 or 7 wherein no two adjacent dimples have substantially similar dimple diameter.

12. The golf ball of claim 11 having about 432 to 440 dimples.

13. The golf ball of claim 11 having about 448 to 456 dimples.

* * * * *